US008989633B2

(12) United States Patent
Nakajima

(10) Patent No.: US 8,989,633 B2
(45) Date of Patent: Mar. 24, 2015

(54) IMAGE FORMING APPARATUS

(75) Inventor: Takao Nakajima, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 129 days.

(21) Appl. No.: 13/449,664

(22) Filed: Apr. 18, 2012

(65) Prior Publication Data

US 2012/0269537 A1 Oct. 25, 2012

(30) Foreign Application Priority Data

Apr. 20, 2011 (JP) ..... 2011-093905

(51) Int. Cl.
*G03G 15/08* (2006.01)

(52) U.S. Cl.
CPC ..... *G03G 15/0886* (2013.01); *G03G 15/0877* (2013.01)
USPC ..... 399/258; 399/260

(58) Field of Classification Search
CPC ..... G03G 15/0817; G03G 15/0898; G03G 15/0841; G03G 2215/0692
USPC ..... 399/102, 103, 106, 160, 255, 258
See application file for complete search history.

(56) References Cited

U.S. PATENT DOCUMENTS

| | | | | |
|---|---|---|---|---|
| 5,621,507 | A * | 4/1997 | Nishimura et al. | 399/111 |
| 7,277,659 | B2 | 10/2007 | Kobayashi et al. | |
| 2005/0220464 | A1 | 10/2005 | Kobayashi et al. | |
| 2009/0041508 | A1 * | 2/2009 | Oshikawa et al. | 399/254 |

FOREIGN PATENT DOCUMENTS

| | | | |
|---|---|---|---|
| JP | 8-30080 | A | 2/1996 |
| JP | 2001-56604 | A | 2/2001 |
| JP | 2002-244424 | A | 8/2002 |
| JP | 2005-292406 | A | 10/2005 |
| JP | 2011-197050 | A | 10/2011 |

* cited by examiner

*Primary Examiner* — David Bolduc
*Assistant Examiner* — Barnabas Fekete
(74) *Attorney, Agent, or Firm* — Fitzpatrick, Cella, Harper & Scinto

(57) ABSTRACT

An image forming apparatus includes an image bearing member; a developing device; a sealing member for unsealably sealing a space containing an initial developer; a first supplying device communicatable with the space to supply the developer into the developing device; a second supplying device for supplying the developer into first supplying device; an unsealing mechanism for unsealing the sealing member; and a controller capable of executing an operation in an unsealing mode in which the unsealing mechanism is operated, after supplying operation of second supplying device, to unseal the sealing member.

5 Claims, 13 Drawing Sheets

(a)

(b)

IMAGE FORMING APPARATUS

FIELD OF THE INVENTION AND RELATED ART

The present invention relates to an image forming apparatus which employs a developing device structured so that its initial supply of developer is kept sealed within the developing means container with the use of specially designed seals. More specifically, it relates to the control sequence for automatically removing the seals of the developing device when an image forming apparatus is set up for image formation.

An image forming apparatus which forms an electrostatic image on its image bearing member, develops the electrostatic image into a toner image (image formed of toner) with the use of its developing device, transfers the toner image onto a sheet of recording medium, and fixes the toner image to the sheet of recording medium by applying heat and pressure to the toner image on the sheet of recording medium, is widely in use. Ordinarily, a brand-new developing device for the above described image forming apparatus is stored in such a state that a preset amount of developer is kept sealed, as the initial supply of developer, in the internal space of the developing means container of the developing device, with a seal (seals). A brand-new developing device is installed into an image forming apparatus as necessary when an image forming apparatus is set up for image formation. After the installation of a brand-new developing device into the image forming apparatus, the initial supply of developer in the developing means container of the developing device is released by unsealing the developing means container by pulling the seal by one end of the seal from outside the developing device, to ready the developing device for the development of an electrostatic latent image (Japanese Laid-open Patent Application 2001-56604 (Patent Document 1)).

A developing device consumes the toner in its developing means container during an image forming operation. However, it has to be kept constant in the amount of toner in the developer in its developing means container, or the toner ratio of the developer in the developing means container. Therefore, it has to be continuously replenished with toner by an amount equal to the amount by which toner was consumed for image formation. For example, in the case of the image forming apparatus disclosed in Japanese Laid-open Patent Application 2002-244424 (Patent Document 2), each developing device is provided with a hopper for replenishing the developing device with toner. The hopper is provided with a toner delivery screw, which is in the bottom portion of the hopper. The amount by which the developing device is replenished with toner is adjusted by controlling (rotating/stopping) the screw.

In recent years, an image forming apparatus has been reduced in size. Thus, a developing device therefor has also been reduced in size. Therefore, it has become difficult to place a large hopper in the main assembly of an image forming apparatus. Further, toner is easily affected by the ambient temperature and humidity. Thus, if toner is left unattended for a substantial length of time in a hopper, it is likely to become difficult to charge, and/or is likely to reduce in fluidity.

Thus, an image forming apparatus 200 shown in FIG. 1 has been invented, and is ready for practical use. The apparatus 200 is structured so that a developer supplying sealed device (Ta) (developer supplying second device) which contains developer (replenishment developer) is removably installable in the main assembly of the apparatus 200. More specifically, each developing device 4*a* is provided with a toner supplying first device (20*a*) for replenishing developing device 4*a* with developer. To the first device 20*a*, developer is delivered as necessary from the aforementioned second device (Ta) so that a preset amount of developer is always in the first device (20*a*). The first device (20*a*) is provided with a developer conveyance screw, which is rotated as necessary to replenish the developing device 4*a* with developer by an amount necessary.

The image forming apparatus 200, however, suffered from the following problem: When both a brand-new developing device 4*a* and a brand-new second device (Ta) were mounted into the image forming apparatus 200 at the same time, and both devices 4*a* and (Ta) were set up at the same time, a phenomenon that a large amount of developer flows into the developing device 4*a* from the second device (Ta), was confirmed. More specifically, the developer from the second device (Ta) flowed straight through the empty first device (20*a*), and furiously flowed, like a surface snowslide, into the developing device 4*a*, which was unsealed, being therefore lower in the surface level of the body of developer therein.

If a large amount of replenishment toner flows into the developing device 4*a*, not only is it likely to occur that uncharged toner particles in the developing device 4*a* are blown upward up like dust, but also, are blown out of the developing device 4*a* through the gaps of the developing device 4*a*.

Further, in a case where the developer in the developing device 4*a* happened to be two-component developer, the develop device 4*a* temporarily became excessive in the developer amount or toner density, which caused the toner to be undercharged, causing thereby the image forming apparatus to output images which were unsatisfactorily low, and/or images which were nonuniform in density.

SUMMARY OF THE INVENTION

Thus, the primary object of the present invention is to provide an image forming apparatus in which replenishment developer is prevented from flowing into its developing device at an excessive speed, and therefore, it does not occur that the developing device is made excessive in developer amount, and/or toner particles scatter through the gaps of the developing device.

According to an aspect of the present invention, there is provided an image forming apparatus comprising an image bearing member for bearing an electrostatic image; a developing device for developing the electrostatic image formed on said image bearing member; a sealing member for unsealably sealing a space containing an initial developer; a first supplying device capable of communicating with the space to supply the developer into said developing device; a second supplying device for supplying the developer into first supplying device; an unsealing mechanism for unsealing said sealing member; and a controller capable of executing an operation in an unsealing mode in which said unsealing mechanism is operated, after supplying operation of second supplying device, to unseal said sealing member.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, the preferred embodiments of the present invention are described in detail with reference to the appended drawings. The present invention is applicable to any image forming apparatus as long as the image forming apparatus employs a developing device, the initial developer supply of which is kept sealed in the internal space of the developer container of the developing device, with developer seals. That is, the present invention is also compatible with image forming apparatuses which are partially or entirely different in structure from those in the following preferred embodiments of the present invention, as long as the apparatuses employs a developing device, the initial developer supply of which is kept sealed in the internal space of the developer container of the developing device, with developer seals.

In other words, the present invention is applicable to various image forming apparatuses regardless of whether the apparatuses are full-color or monochromatic apparatuses, whether the apparatuses employ a single or multiple drums, whether they use single-component or two-component developer, and whether they are of the direct transfer type, recording medium conveyance type, or intermediary transfer type. Further, the present invention is applicable to various image forming apparatuses regardless of their charging method, exposing method, and photosensitive drum type. In the following description of the preferred embodiments of the present invention, only the portions of an image forming apparatus, which are essential to the formation and transfer of a toner image are going to be described. However, the present invention is applicable to various printers, copying machines, facsimile machines, multifunction image forming apparatuses, etc., which are a combination of the portions of an image forming apparatus, which are going to be described next, and additional devices, equipments, structural frames, etc.

<Image Forming Apparatus>

Figure 1:
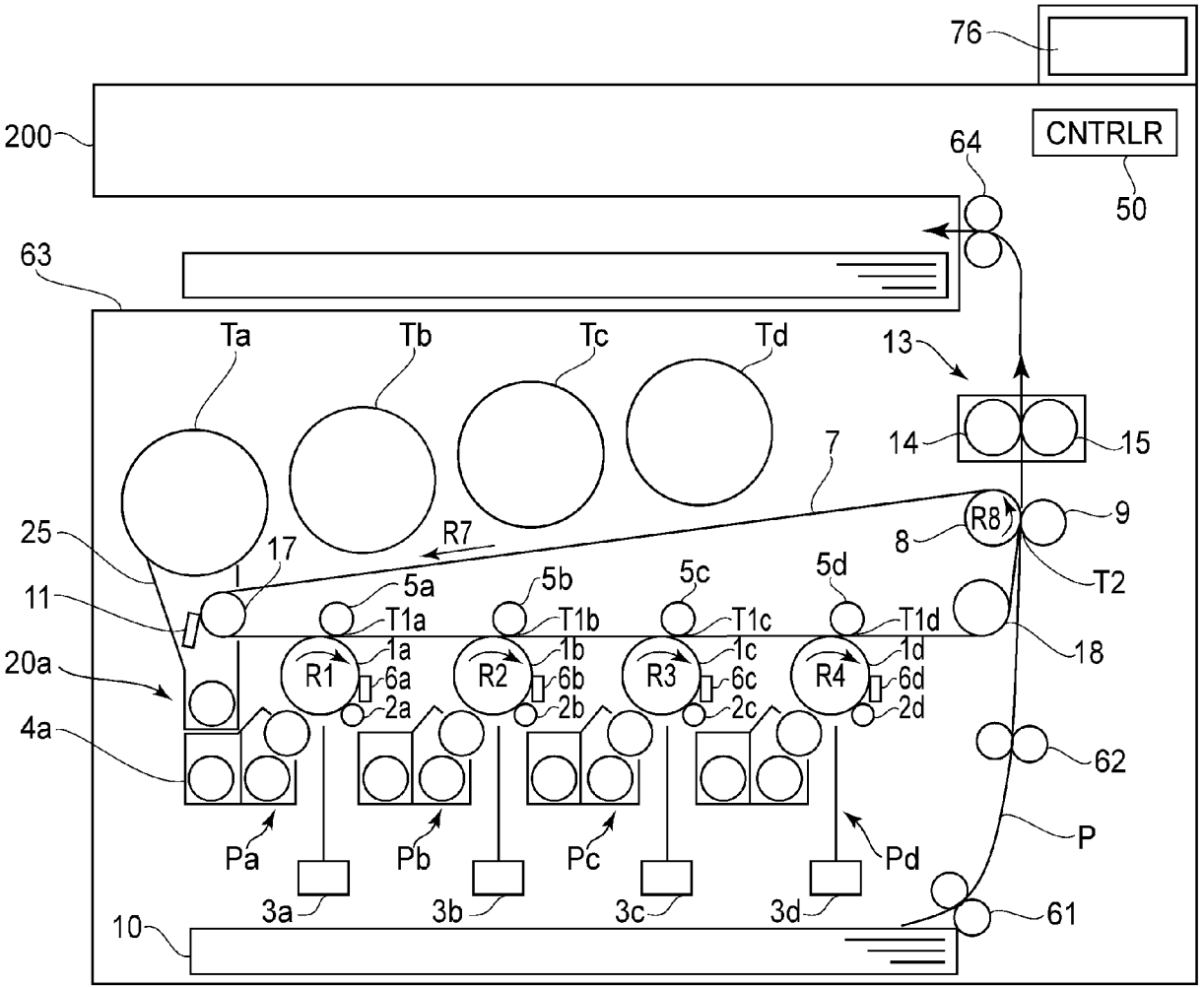
FIG. 1 is a schematic sectional view of the image forming apparatus in the first embodiment of the present invention, and shows the general structure of the apparatus.

FIG. 1 is a schematic sectional view of an example of an image forming apparatus to which the present invention is applicable. It shows the general structure of the apparatus. Referring to FIG. 1, an image forming apparatus 200 is a full-color printer of the so-called tandem-type, and also, of the so-called intermediary transfer type. It has image formation stations Pa, Pb, Pc and Pd, and an intermediary transfer belt 7. The image formation stations Pa, Pb, Pc and Pd are under the loop which the intermediary transfer belt 7 forms. They are aligned in the direction parallel to the moving direction of the intermediary transfer belt 7. An image forming apparatus of the tandem-type is highly productive, and also, is capable of dealing with various recording mediums. Therefore, it has become one of the mainstream image forming apparatuses. Referring to FIG. 1, the front-to-rear direction of the image forming apparatus 200 is the direction perpendicular to the sheet of paper on which FIG. 1 is drawn.

In the image formation station Pa, a yellow toner image is formed on the photosensitive drum 1*a*, and is transferred onto the intermediary transfer belt 7. In the image formation station Pb, a magenta toner image is formed on the photosensitive drum 1*b*, and is transferred onto the intermediary transfer belt 7. In the image formation stations Pc and Pd, cyan and black toner images are formed on the photosensitive drums 1*c* and 1*d*, respectively, and are transferred onto the intermediary transfer belt 7. However, the number of colors does not need to be limited to four, and the order in which monochromatic color images are to be formed does not need to be limited to the above-mentioned order.

After the transfer of the four monochromatic toner images, different in color, onto the intermediary transfer belt 7, the four toner images are conveyed to the secondary transfer station T2, and are transferred together (second transfer) onto a sheet P of recording medium. Then, the sheet P and the toner images thereon are subjected to heat and pressure by the fixing device 13, whereby the toner images are fixed to the surface of the sheet P. Then, the sheet P is discharged into a delivery tray 36 by way of a pair of discharge rollers 64.

After a sheet or sheets P of recording medium are pulled out of a recording medium cassette 10, a pair of separation rollers 61 separate the top sheet P from the rest, and send the sheet P to a pair of registration roller 62, which keep the sheet P on standby. Then, the registration rollers 62 send the sheet P to the secondary transfer station T2 with the same timing as that with which the toner images on the intermediary transfer belt 7 are sent into the secondary transfer station T2.

The fixing device 13 has a fixation roller 14 and a pressure roller 15. The fixation roller 14 is provided with a heater. The pressure roller 15 is pressed against the fixation roller 14, forming thereby a heating nip between itself and fixation roller 14. The sheet P of recording medium, on which the toner images are present, is conveyed through heating nip while being subjected to heat and pressure. Thus, as the sheet P is conveyed through the heating nip, the toner images are melted, effecting thereby a full-color image. Then, as the sheet P conveyed out of the fixing device 13, the melted toner images (full-color image) cool down, becoming fixed to the surface of the sheet P.

The image formation stations Pa, Pb, Pc and Pd are virtually the same in structure, although they are different in the color (yellow, magenta, cyan, and black) of the toner used by their developing devices 4*a*, 4*b*, 4*c* and 4*d*, respectively. Hereafter, therefore, only the image formation station Pa is described in detail. The description of the other image formation stations Pb, Pc and Pd are the same as that of the station Pa, except for the suffixes b, c and d of their referential code.

The image formation station Pa comprises a photosensitive drum 1*a*, and six drum processing means, more specifically, a charge roller 2*a*, an exposing device 3*a*, a developing device 4*a*, a transfer roller 5*a* and a drum cleaning device 6*a*. The drum processing means are in the adjacencies of the peripheral surface of the photosensitive drum 1*a*. The photosensitive drum 1*a* is made up of an aluminum cylinder, and a photosensitive layer formed on the peripheral surface of the aluminum cylinder. It is rotated at a preset process speed.

The charge roller 2*a* uniformly and negatively charges the peripheral surface of the photosensitive drum 1*a* to a preset potential level. The exposing device 3 writes an electrostatic image on the uniformly charged area of the peripheral surface of the photosensitive drum 1*a* by scanning the uniformly charged area with a beam of laser light which it emits while modulating (turning on or off) the beam, according to the image formation data (scanning line data) obtained by unfolding the yellow monochromatic image resulting from the separation of the image to be formed, into monochromatic images. The developing device 4*a* develops the electrostatic image into a visible image, that is, an image formed of toner, by supplying the peripheral surface of the photosensitive drum 1*a* with toner.

The transfer roller 5*a* presses the intermediary transfer belt 7 upon the peripheral surface of the photosensitive drum 1*a*, forming thereby the primary transfer station Ta between the peripheral surface of the photosensitive drum 1*a* and intermediary transfer belt 7. As DC voltage is applied to the transfer roller 5*a*, the toner image on the peripheral surface of the photosensitive drum 1*a* is transferred (primary transfer) onto the portion of the intermediary transfer belt 7, which is being conveyed through the primary transfer station Ta. The drum cleaning device 6*a* has a cleaning blade, which is positioned to scrape the peripheral surface of the photosensitive drum 1*a* so that the transfer residual toner, that is, the toner remaining adhered to the portion of the peripheral surface of the photosensitive drum 1*a*, which is on the downstream side of the primary transfer station Ta in terms of the moving direction of the peripheral surface of the photosensitive drum 1*a*.

The intermediary transfer belt 7 is supported and kept stretched by a tension roller 17, a belt driving roller 8, and a roller 18. The belt driving roller 8 doubles as a roller which opposes the secondary transfer roller 9 to back up the intermediary transfer belt 7. The intermediary transfer belt 7 is driven by the belt driving roller 8 so that it is circularly moved in the direction indicated by an arrow mark R7.

The secondary transfer station T2 is the area of contact between the outward surface of the intermediary transfer belt 7, and the peripheral surface of the secondary transfer roller 9. As DC voltage is applied to the secondary transfer roller 9, the multicolor toner image (layered four monochromatic toner images) is transferred (secondary transfer) onto a sheet P of recording medium while the sheet P is conveyed through the secondary transfer station T2, remaining pinched by the intermediary transfer belt 7 and secondary transfer roller 9. The belt cleaning apparatus 11 has a cleaning blade. It removes the transfer residual toner, that is, the toner remaining adhered to the portion of the outward surface of the intermediary transfer belt 7, which is on the downstream side of the secondary transfer station T2*a* in terms of the moving direction of the intermediary transfer belt 7.

There are toner containers Ta, Tb, Tc and Td above the developing devices 4*a*, 4*b*, 4*c* and 4*d*, respectively. As the toner in the developing devices 4*a*, 4*b*, 4*c* and 4*d* is consumed for image formation, the developing devices 4*a*, 4*b*, 4*c* and 4*d* are replenished with the toner from the toner bottles (containers) Ta, Tb, Tc and Td by an amount equal to the amount of the toner consumption.

The image forming apparatus 200 employs the so-called process cartridge system, which integrates the photosensitive drum 1*a* and the means (which includes developing device) for processing the photosensitive drum 1*a*, in the form of a cartridge which is removably mountable in the main assembly of the image forming apparatus 200. The process cartridge system makes it possible for a user to maintain an image forming apparatus by the user him- or herself, that is, without relying on a service person. Thus, it can drastically improve an image forming apparatus in operability, and therefore, is widely in use in the field of an image forming apparatus.

The image forming apparatus 200 employs a process cartridge structured so that the toner storage in the process cartridge is kept hermetically sealed with a seal until the process cartridge is used for the first time (setup). Thus, as the process cartridge is installed into the main assembly of the image forming apparatus 200, the image forming apparatus 200 carries out the control sequence for automatically removing the seal.

<Developing Device>

Figure 2:
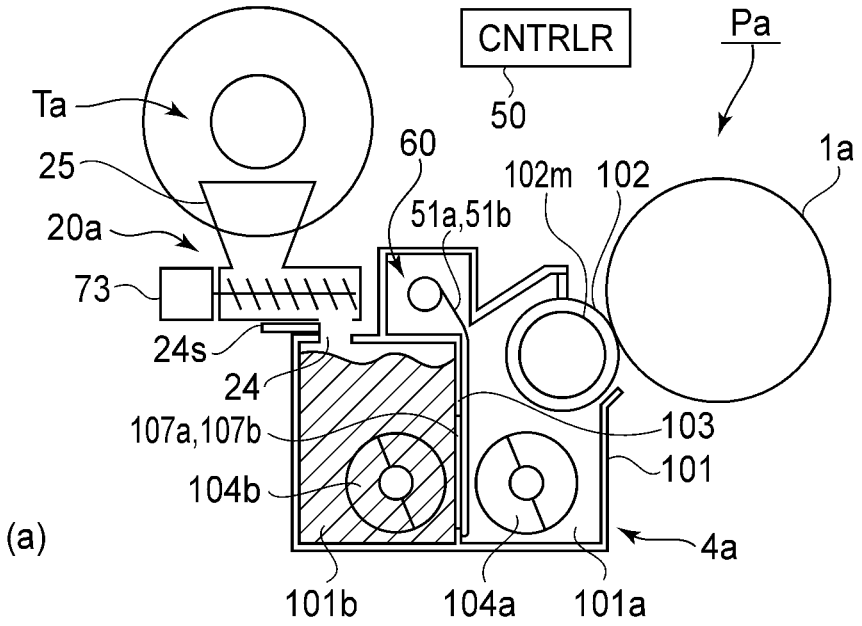
FIG. 2 is a schematic sectional view of the developing device in the first embodiment of the present invention, at a plane perpendicular to the axial line of the development roller of the device, and shows the general structure of the device.
Figure 2:
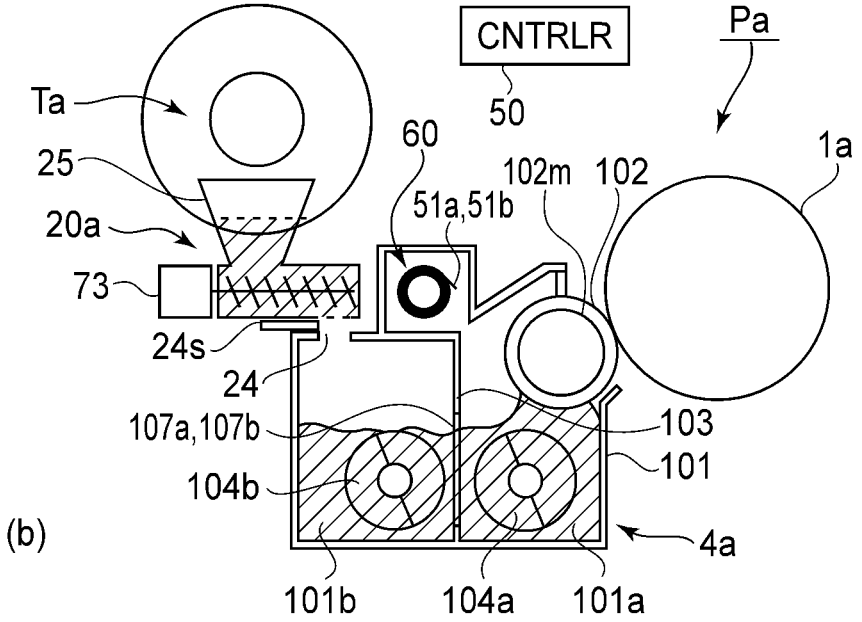

FIG. 2 is a schematic sectional view of one of the developing devices in the image forming apparatus 200, at a plane perpendicular to the axial line of the development roller of the developing device, prior to (FIG. 2(*a*)) and after (FIG. 2(*b*)) the unsealing of the toner storage of the developing device. It shows the general structure of the device. Referring to FIG. 2(*b*), the photosensitive drum 1*a*, which is an example of an image bearing member, is processed by the developing device 4*a;* the electrostatic image on the peripheral surface of the photosensitive drum 1*a* is developed by the developing device 4*a*. A toner supplying device 20*a* is an example of a first device for replenishing the developing device 4*a* with toner. It is connectible to the toner storage space, which holds the initial supply of developer and is kept sealed until the developing device 4*a* is used for the first time. It can replenish the developing device 4*a* with toner. A toner container Ta is an example of a second device for replenishing the developing device 4*a* with toner. It replenishes the toner supplying device 20*a* with toner.

The developing device 4*a* develops the electrostatic image on the peripheral surface of the photosensitive drum 1*a*, by charging the developer in the developing means container 101 and making the development sleeve 102 to bear the charged developer. The developing means container 101 contains two-component developer, which is a mixture of toner (non-magnetic) and carrier (magnetic). The toner and carrier are circulated in the developing means container 101 by a development chamber screw 104*a* and a stirring chamber screw 104*b*, which are in the developing means container 101. As the developer is circulated in the container 101, the toner is charged by the friction between the toner and carrier.

There is a non-rotational magnetic roller 102*m* in the hollow of the development sleeve 102. Thus, the developer is magnetically held to the peripheral surface of the development sleeve 102 by the magnetic force of the magnetic roller 102*m*. As an oscillatory voltage, more specifically, a combination of DC and AC voltages, is applied to the development sleeve 102, only the toner in the developer transfers onto the photosensitive drum 1*a*.

Figure 3:
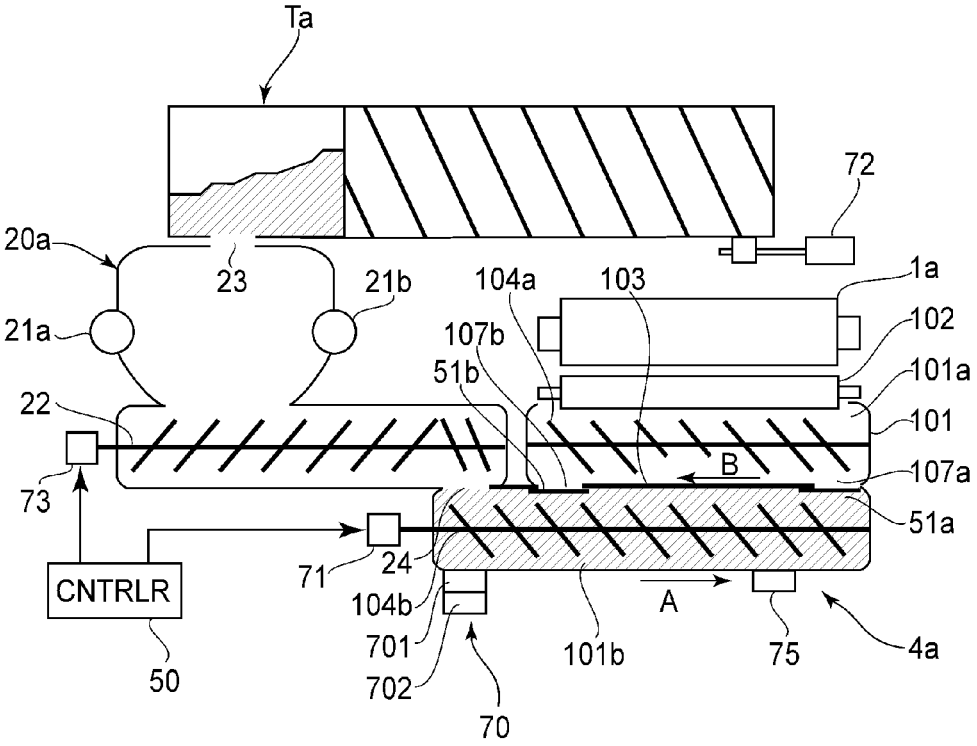
FIG. 3 is a schematic sectional view of the development device, prior to its unsealing, in the first embodiment of the present invention at a plane which is parallel to, and coincides with, the axial line of the development roller of the device. It shows the general structure of the device.

Referring to FIG. 3, the internal space of the developing means container 101 has a development chamber 101*a* and a stirring chamber 101*b*, which are partitioned from each other by a partitioning wall 103. The partitioning wall 103 has a pair of openings 107*a* and 107*b*, which are in the lengthwise end portions of the wall 103, one for one. Thus, the development chamber 101*a*, stirring chamber 101*b*, and pair of openings 107*a* and 107*b* make up a passage through which the developer is circularly movable. Therefore, as the developer flows into the development chamber 101*a* from the stirring chamber 101*b* through the opening 107*a*, it is conveyed by the development chamber screw 104*a* in the direction indicated by an arrow mark B, and while it is conveyed, some of it is borne on the peripheral surface of the development sleeve 102 by being magnetically held to the peripheral surface of the development sleeve 102.

The developer which was not electromagnetically held to the peripheral surface of the development sleeve 102 is conveyed by the development chamber screw 104*a* to the downstream end of the development chamber 101*a*, and flows from the development chamber 101*a* into the stirring chamber 101*b* through the opening 107*b*. Then, it is stirred by the stirring chamber screw 104*b* while being conveyed by the stirring chamber screw 104*b* in the direction indicated by an arrow mark A. Thus, the toner and carrier are given triboelectric charge.

<Control Sequence for Replenishing Developing Device with Toner>

Figure 4:
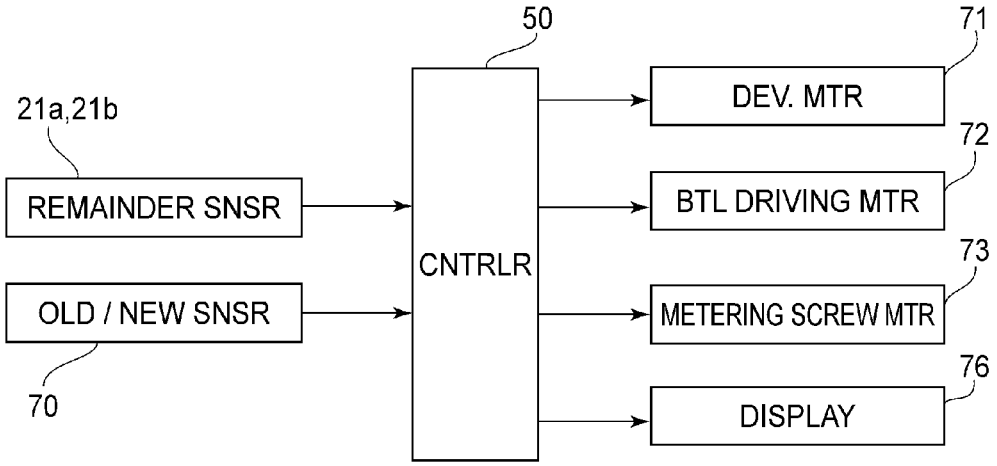
FIG. 4 is a block diagram of a combination of the control sequence for replenishing the developing device with toner, and the control sequence for releasing the initial supply of developer in a brand-new developing device.

FIG. 4 is a block diagram of the control sequence for replenishing the developing device 4*a* with toner, and releasing the initial supply of developer (unsealing a brand-new cartridge). Referring to FIG. 4, to the control section 50 of the image forming apparatus 200, the information about the amount of the residual toner in the cartridge detected by the residual toner amount sensors 21*a* and 21*b*, and the information about whether or not the developing device 4*a* in the image forming apparatus 200 is brand-new, are inputted. The control section 50 activates a development motor 71, a bottle motor 72, and a measurement screw motor 73, based on a prescribed flowchart. The image forming apparatus 200 is provided with a display on which the information about the status of the image forming apparatus 200, which is based on the control sequence, is displayed. The developing device 4*a* is provided with an external memory tag 701. The image forming apparatus 200 is provided with a developing device status sensor 70 for determining whether or not the developing device 4*a* in the apparatus 200 is brand-new. As the developing device 4*a* is installed into the image forming apparatus 200, the memory tag 701 of the sensor 70 comes into contact with the receiver portion 702 of the image forming apparatus 200, and the receiver portion 702 writes information into the memory tag 701. More specifically, the information which is to be recorded realtime in the memory tag 701 is whether or not the developing device 4*a* is brand-new, and cumulative number of images formed. Not only is this information used by the control sequence for replenishing the developing device 4*a* with toner, but also, for setting the conditions for the image forming processes such as development, charging, and transfer.

Next, referring to FIG. 3, in order to ensure that the image forming apparatus 200 continuously outputs images of good quality, the image forming apparatus 200 must be kept stable in image density. Thus, the developing device 4*a*, which uses two-component developer, has to be kept constant in the toner density (T/D ratio), that is, the toner ratio (weight ratio) of the developer which is being circulated in the developing means container 101. Therefore, as the toner in the developing device 4*a* is consumed for image formation, the toner supplying device 20*a* quickly replenishes the developing device 4*a* with toner by an amount equal to the amount of the toner consumption by the image formation. It is only the toner in the developer that is transferred onto the photosensitive drum 1*a* and consumed during an image forming operation. Each time an image is formed, the control section 50 calculates the amount by which toner is consumed for the formation of the image, and activates the toner supplying device 20*a* to replenish the developing device 4*a* with toner by an amount equal to the amount by which toner was consumed for the formation of the image. However, as the developing device 4*a* is replenished with toner each time an image is formed, errors accumulate in the amount by which the developing device 4*a* is replenished with toner, making it possible for the toner density (T/D ratio) of the developer in the developing means container 101 to fall out of a proper range. Therefore, the control section 50 controls the toner supplying device 20*a*, based on the output of a permeability sensor 75, so that the toner density of the developer in the developing means container 101 is kept within a range of 8-10%.

As the toner container Ta is rotated by the bottle motor 72, it conveys the toner therein in such a manner that the toner follows the spiral ridge on the inward surface of the cylindrical portion of the container Ta, and is delivered to the hopper 25 of the toner supplying device 20*a* through the opening 123. The hopper 25 is provided with the pair of residual toner amount detection sensors 21*a* and 21*b*, which make up a photo-interrupter, and are on the inward surface of the hopper 25. The hopper 25 is provided with a measurement screw 22, which is in the cylindrical bottom portion of the hopper 25. As the measurement screw 22 is rotated by the measurement screw motor 73, the toner in the hopper is delivered to the developing device 4*a* through the toner delivery opening 24, by an amount proportional to the angle by which the measurement screw 22 is rotated.

The control section 50 rotates the bottle motor 72 until the body of toner having accumulated in the hopper 25 blocks the beam of light between the residual toner amount sensors 21*a* and 21*b*, that is, until the amount of the toner in the hopper reaches a preset value. Then, the control section 50 controls (turns on or off) the measurement screw motor 73 to deliver toner from the hopper 25 to the developing means container 101 by the amount necessary to keep the developer in the developing device 4*a* satisfactory in toner ratio.

The toner delivery opening 24 is provided with a pair of shutters. One of the shutters is on the hopper side, and the other is on the developing device side. It is from the front side of the apparatus 200 that the developing device 4*a* is installed into the image forming apparatus (200 in FIG. 1). As the developing device 4*a* is inserted into the apparatus 200, the shutter on the developing device side and the shutter on the hopper side open, whereby the hopper 25 becomes connected to the developing means container 101 through the toner delivery opening 24. On the other hand, as the developing device 4*a* is pulled out of the image forming apparatus (200 in FIG. 1) from the front side of the apparatus 200, both the shutter on the hopper side and the shutter on the developing device side are closed, whereby both the hopper 25 and developer means container 101 are sealed; the passage between the hopper 25 and developing means container 101 is eliminated. Therefore, it does not occur that toner is scattered from the joint between the hopper 25 and developing means container 101.

<Operation for Releasing Initial Supply of Developer>

Figure 5:
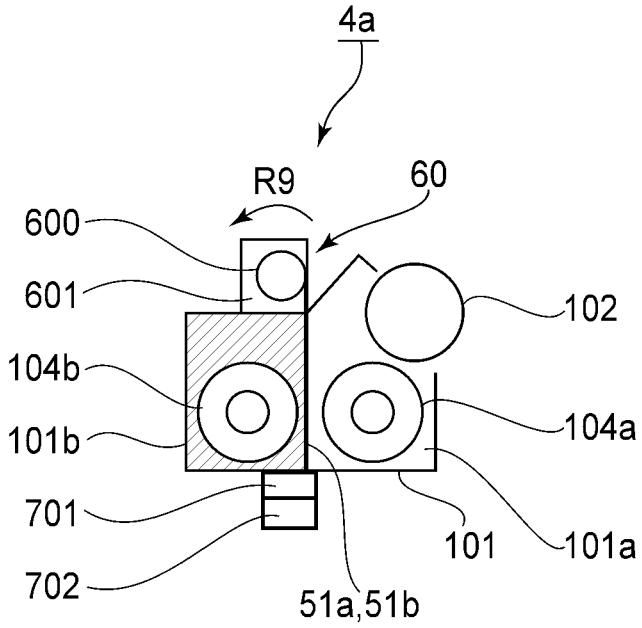
FIG. 5 is a schematic sectional view of the developing device in the first embodiment of the present invention, and shows the developing device mechanism for unsealing the device.
Figure 5:
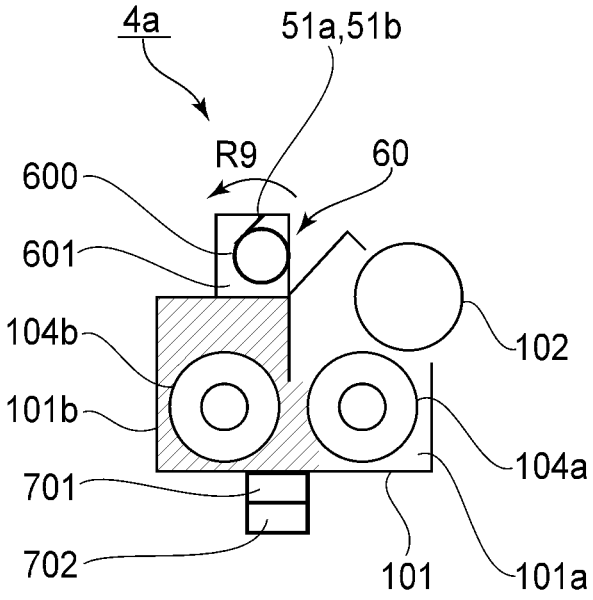

FIG. 5 is a schematic sectional view of the developing device in the first embodiment of the present invention, and shows the seal removing mechanism (developing device unsealing mechanism) of the developing device. Until the developing device 4*a* is unsealed for the first time, the initial supply of developer in the developing device 4*a* remains sealed in the internal space of developing means container 101 by seals 51*a* and 51*b*, that is, examples of a developing device seal as shown in FIG. 3.

When the developing device 4*a* is brand-new, its openings 107*a* and 107*b* are kept sealed with seals 51*a* and 51*b*, respectively, and therefore, there is no passage between the stirring chamber 101*b* and development chamber 101*a*. It is in the stirring chamber 101*b* that the initial supply of developer (preset amount of developer) is stored. That is, when the developing device 4*a* is brand-new, there is no developer (no carrier and no toner) is in the development chamber 101*a*. The seals 51*a* and 51*b* in this embodiment are made of a sheet of resin which is 0.1 mm in thickness. The material for the seals 51*a* and 51 includes polyester. However, the material and shape for the seals 51*a* and 51*b* do not need to be limited to those in this embodiment.

Referring to FIG. 2(*a*), the seals 51*a* and 51*b* are thermally welded to the edge portions of the openings 107*a* and 107*b*, respectively, by their fringe areas. As the mechanism 60 for removing the seals 51*a* and 51*b* winds the seals 51*a* and 51*b* upward, the seals 51*a* and 51*b* are peeled away from the edges of the openings 107*a* and 107*b* from the bottom-to-top direction, unsealing thereby the stirring chamber 101*b*, that is, the chamber in which the initial supply of developer has been kept sealed.

Next, referring to FIG. 2(*b*), as the seals 51*a* and 51*b* are removed from the openings 107*a* and 107*b*, respectively, it becomes possible for the initial supply of developer in the stirring chamber 101*b* to flow into the development chamber 101*a*, and be circularly moved in the developing device chamber through the development chamber 101*a*, opening 107*a*, stirring chamber 101*b*, and opening 107*b*. Then, the development chamber screw 104*a* and stirring chamber screw 104*b* are activated to ready the developing device 4*a* for an image forming operation.

Next, referring to FIG. 4, a development motor 71 rotates the development chamber screw 104*a*, stirring chamber screw 104*b*, development sleeve 102, and seal winding member 60 together. As the stirring chamber screw 104*b* is rotated, the developer in the stirring chamber 101*b* is conveyed in the direction indicated by an arrow mark A. As the development chamber screw 104*a* is rotated, the developer in the development chamber 101*a* is conveyed in the direction indicted by an arrow mark B. At the same time, the seal winding member 60 winds up the seals 51*a* and 51*b*, releasing thereby the initial supply of developer in the stirring chamber 101*b*.

The developing device 4*a* is structured so that the stirring chamber 101*b* in the developing device 4*a* is kept hermetically sealed with the seals 51*a* and 51*b* until the developing device 4*a* is used for the first time. It has been discovered that if the developing device 4*a* in the image forming apparatus 200 is brand-new, and the toner supplying device 20*a* and toner container Ta are activated at the same time as when the developing device 4*a* is activated to remove the seals 51*a* and 51*b*, it is likely for the toner to scatter from the developing device 4*a*. More specifically, if replenishment developer is delivered from the second toner replenishment device with a certain timing which corresponds to the timing with which the seals 51*a* and 51*b* are wound, it sometimes occur that the gravitation potential of the replenishment developer will cause the replenishment developer to travel straight through the first replenishment device (without stopping in first replenishment device), and reach the developing means container 101 while maintaining a certain amount of velocity. As the replenishment developer reaches the developing means container 101 while maintaining a certain amount of speed, it sometimes scatters through the gaps between the developer bearing member and image bearing member. Further, in a case where the developing device 4*a* uses two-component developer, the replenishment toner mixes with the initial supply of developer in the developing means container 101, unintendedly increasing thereby the initial supply of developer in toner ratio. Thus, the image forming apparatus 200 sometimes outputs images which are nonuniform in density.

It has been discovered that if there is a certain relationship between the timing with which replenishment toner is delivered from the toner container Ta to the developing device 4*a* equipped with a device (60) for automatically removing the seals 51*a* and 51*b*, and the timing with which the seals 51*a* and 51*b* are wound away, the replenishment toner flows into the developing device 4*a* by an amount greater than necessary. As replenishment toner is delivered from the toner container Ta to the toner supplying device 20*a* when the device 20*a* is empty, the gravitational potential of the toner does not allow to the toner stay in the hopper, and causes the toner to travel straight through the toner supplying device 20*a*, (without stopping in device 20*a*), and reach the developing means container 101 while maintaining a certain amount of speed. Then, it slides on the surface of the body of initial supply of developer in the developing means container 101, and flows into the development chamber 101*a* through the opening 107*b*. Then, it sometimes scatters through the gaps between the development sleeve 102 and developing means container 101.

Further, if replenishment toner flows into the developing means container 101 by a large amount from the toner container Ta, the developer in the developing means container 101, which is to be circularly conveyed in the developing means container 101 is temporarily increased in toner density (T/D ratio), which in turn reduces the toner in the developer in the developing means container 101 in average amount of charge (Q/M). When this phenomenon occurred, the image forming apparatus 200 outputted images which were low in overall density, and/or nonuniform in density (certain areas of image are low in density).

In the following preferred embodiments of the present invention, the timing with which the seals 51*a* and 51*b* are removed when the image forming apparatus 200 is in the setup mode (seal removal mode) is adjusted to prevent the occurrence of the above described problematic phenomena, that is, the scattering of toner, and outputting of images insufficient in density and/or nonuniform in density.

<Embodiment 1>

Figure 6:
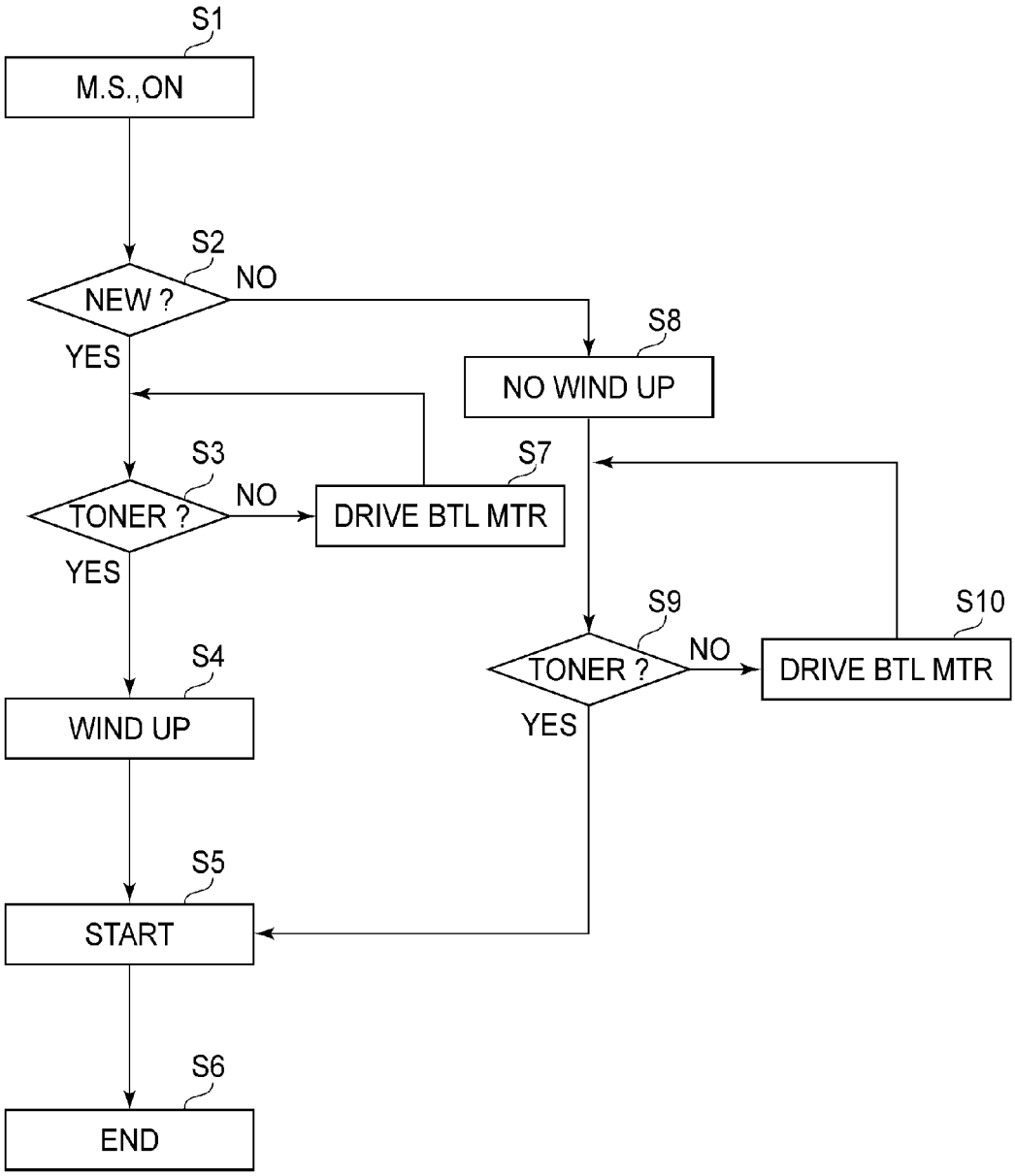
FIG. 6 is a flowchart of the control sequence, in the first embodiment, for winding away (removing) the developer seals.
Figure 7:
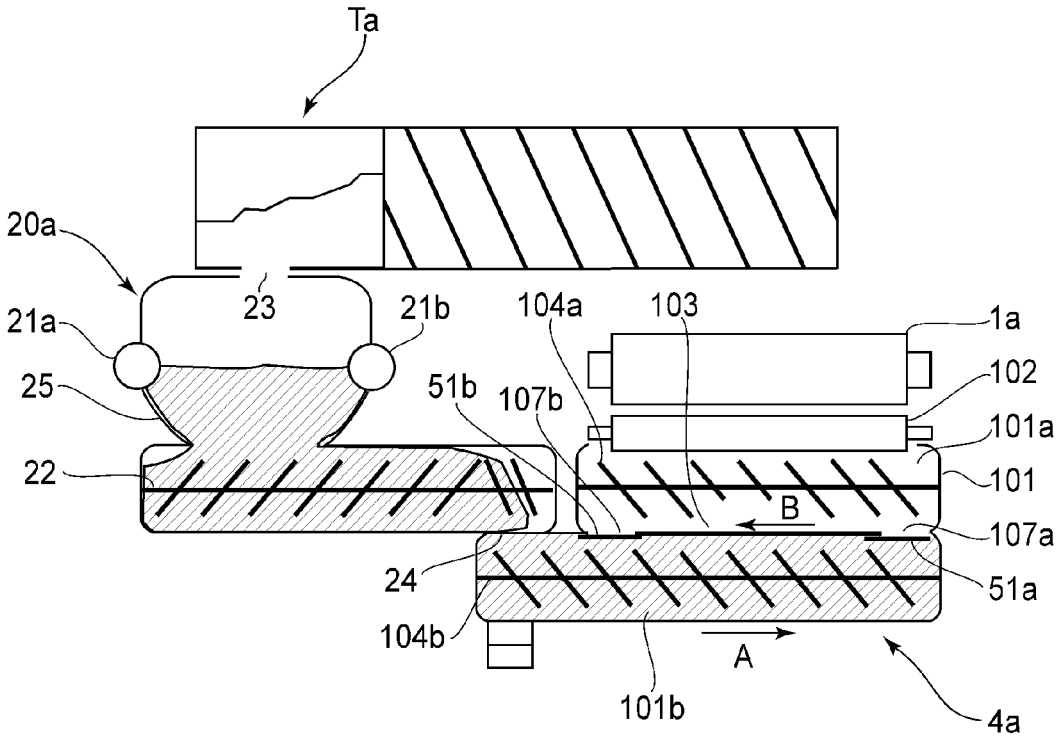
FIG. 7 is a schematic sectional view of the developing device in the first embodiment, prior to the unsealing of the device (prior to removal of developer seals), and shows where in the developing device the replenishment toner and initial supply of developer are prior to the removal of developer seals.
Figure 8:
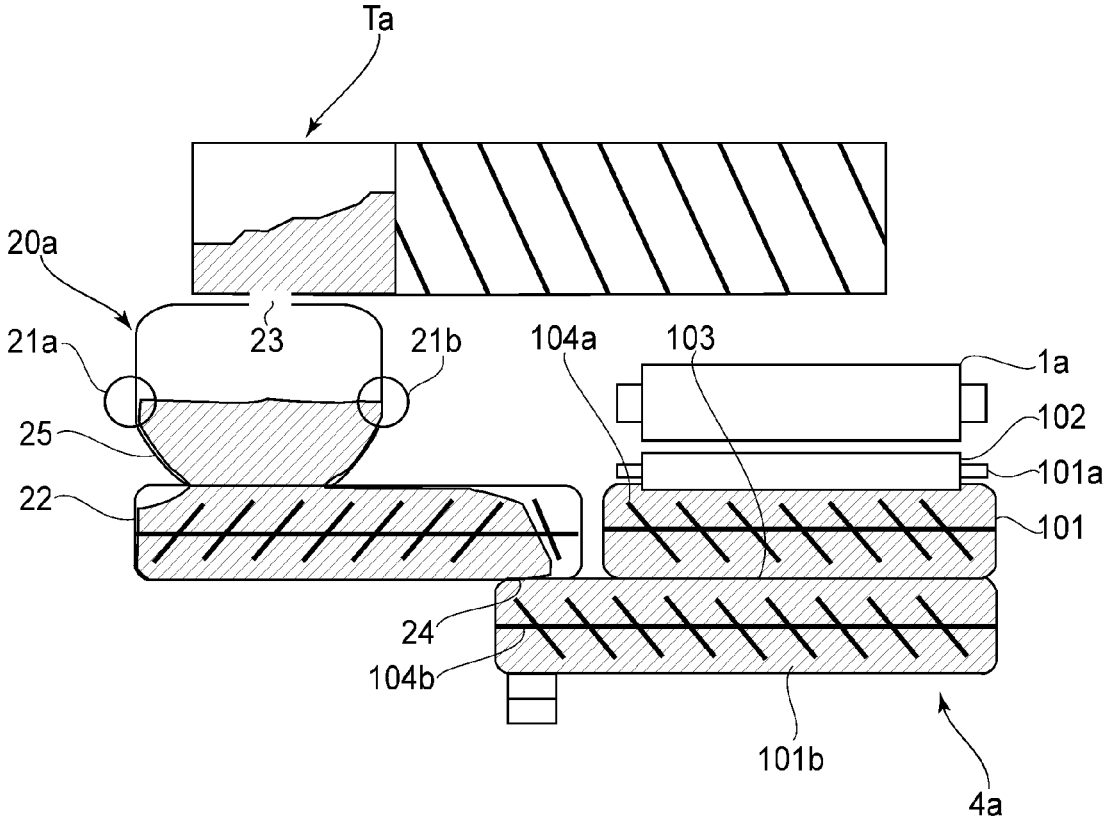
FIG. 8 is a schematic sectional view of the developing device in the first embodiment, after the unsealing of the device (after removal of developer seals), and shows where in the developing device the replenishment toner and initial supply of developer are after the removal of developer seals.

FIG. 6 is a flowchart of the control sequence for winding up the seals 51*a* and 51*b* in the first embodiment. FIG. 7 is a schematic sectional view of the developing device in the first embodiment, prior to the unsealing of the device (removal of seals 51*a* and 51*b*), and shows the structure and state of the device prior to the unsealing of the device. FIG. 8 is a schematic sectional view of the developing device in the first embodiment, after the removal of the seals 51*a* and 51*b* (unsealing of the device), and shows the structure and state of the device after the removal of the seals 51*a* and 51*b*.

In the first embodiment, replenishment developer is delivered from the second replenishment device into the empty space in the developing means container 101 through the first replenishment device, before the removal of the seals 51*a* and 51*b*, that is, while the surface of the body of initial supply of developer in the developing device 4*a* is at the highest level. Therefore, there is only a little space, in the developing means container, into which replenishment developer can flow. Since the surface of the body of the initial supply of developer is at the highest level, the replenishment developer is reduced in speed and inertia. In other words, the developing device 4*a* is unsealed (seals 51*a* and 51*b* are removed) after the replenishment developer flows into the first replenishment device, and settles (lose its fluidity) in the first replenishment device. Therefore, it does not occur that replenishment developer flows into the developing means container by an excessive amount after the removal of the seals 51*a* and 51*b*.

Therefore, it is prevented that replenishment developer flows into the developing device 4*a* by an excessive amount when the image forming apparatus 200 is set up. Therefore, it does not occur that the developing device 4*a* becomes excessive in the amount of toner. Therefore, unsatisfactory development and the like attributable to the overfilling of the developing device 4*a* by the toner does not occur.

Referring again to FIG. 1, the developing device 4*a* is removably installed in the main assembly of the image forming apparatus 200, which has the photosensitive drum 1*a* and toner supplying device 20*a*. the image forming apparatus 200 is set up while the developing devices 4*a*, 4*b*, 4*c* and 4*d*, and toner containers Ta, Tb, Tc and Td are remaining unsealed (toner supplying devices 20*a* 20*b*, 20*c* and 20*d* are not shown) are empty.

Next, referring to FIG. 2, the seal removing mechanism 60 is a part of the developing device 4*a*, and removes the seal 51*a* and 51*b* of the developing device 4*a*.

Next, referring to FIG. 3, the developing device 4*a* is provided with the memory tag 701, which is an example of a memory element. The memory tag 701 stores information which makes it possible for the control section 50 to determine whether or not the developing device 4*a* in the main assembly of the image forming apparatus 200 is literally brand-new, that is, whether the initial supply of developer is still kept sealed in the stirring chamber 101*b* with the seals 51*a* and 51*b*. The control section 50 reads the memory tag 701, and makes the image forming apparatus 200 operate in the seal removal mode only when the developing device 4*a* is literally brand-new.

The control section 50 can make the image forming apparatus 200 operate in the seal removal mode. In the seal removal mode, the toner container Ta is activated to replenish the toner supplying device 20*a* with replenishment toner by an amount no less than a preset value, and after the replenishment of the toner supplying device 20*a* with toner, the seal removal mechanism 60 is activated to remove the seals 51*a* and 51*b*.

The residual toner amount sensors 21*a* and 21*b*, which are examples of a sensor, can detect the amount of the replenishment toner in the toner supplying device 20*a*, which is one of the first replenishment devices in the main assembly of the image forming apparatus 200. In the seal removal mode, the control section 50 activates the seal removal mechanism 60, based on the amount of replenishment toner in the toner supplying device 20*a* detected by the residual toner amount sensors 21*a* and 21*b*, only when the amount of toner in the toner supplying device 20*a* is no less than a preset value.

Next, referring to FIG. 6, as the main assembly of the image forming apparatus 200 is turned on (S1), the control section 50 determines whether or not the developing device 4*a* in the main assembly is literally brand-new, based on the signals from the developing device status sensor 70 (S2). If the developing device 4*a* is brand-new, the control section 50 detects the amount of toner in the toner supplying device 20*a* with the use of the residual toner amount sensors 21*a* and 21*b* (S3).

If the amount of toner in the toner supplying device 20*a* is such that the top surface of the body of toner in the device 20*a* is below the residual toner amount sensor 21*a* and 21*b*, the control section 50 does not turn on the developing means motor 71, but activates the bottle motor 72 to toner container Ta to supply the hopper 25 with toner (S7).

At this point in time, the initial supply of developer in the developing means container 101 is still kept sealed in the stirring chamber 101*b* by the partition wall 103, seal 51*a* and seal 51*b*. Therefore, it does not occur that when toner is delivered to the developing means container 101 from the toner container Ta, it travels straight through the developing means container 101 while maintaining the speed at which it was delivered to the developing means container 101. Therefore, it does not occur that toner scatters through the gap (SD gap) between the development sleeve 102 and photosensitive drum 1*a*, where developer is not yet to be present. Further, it also does not occur that a large amount of uncharged toner mixes into the initial supply of toner. Therefore, it does not occur that the amount of toner charge in the developing device 4*a* is unintendedly made to fluctuate, by the large amount of uncharged toner delivered from the toner container Ta. Therefore, it does not occur that the image forming apparatus 200 changes in image density, and/or outputs images which are nonuniform in density, after the removal of the seals 51*a* and 51*b* from the brand-new developing device in the image formation station Pa.

Referring to FIG. 7, as the toner container Ta is rotated, the hopper 25 increases in the amount of toner therein. Then, as the top surface of the body of toner in the hopper 25 rises as high as the residual toner amount sensor 21*a* and 21*b*, the control section 50 activates the development motor 71 to operate the developing device 4*a*.

Next, the control section 50 rotates the seal winding member 60 in the direction indicated by an arrow mark R9 to peel away the seals 51*a* and 51*b* from the edges of the openings 107*a* and 107*b* of the partition wall 103 by winding up the seals 51*a* and 51*b*, as shown in FIG. 5(*a*) (S4).

Next, referring to FIG. 5(*b*), as the development motor 71 is rotated for a preset length of time, the end portions of the seals 51*a* and 51*b*, which are remaining adhered to the partition wall 103, are finally separated from the wall 103, and the seals 51*a* and 51*b* are wound up into the seal storage chamber 601. Even after the seals 51*a* and 51*b* are wound up into the seal storage chamber, the seal winding member 60 rotates in the direction indicated by the arrow mark R9 each time the development motor 71 is rotated to operate the developing device 4*a*. However, the direction indicated by the arrow mark R9 is not the direction for loosening the seals 51*a* and 51*b* from the seal winding member 60. Therefore, the seals 51*a* and 51*b* remain wound in the seal storage chamber 601.

Next, referring to FIG. 8, as the development motor 71 rotates, the development chamber screw 104*a* and stirring chamber screw 104*b* rotate. Thus, the development chamber 101*a* also is supplied with the developer. Eventually, the developer begins to be circularly moved in the developing device 4*a;* it is moved from the development chamber 101*a* back into the stirring chamber 101*b* through the opening 107*b*, and then, into the stirring chamber 101*b* through the opening 107*a*. Then, the control section 50 starts an image forming operation (S5).

If the control section 50 determines, based on the information from the developing device status sensor 70, that the developing device 4*a* in the image forming apparatus 200 is not brand-new (No in S2), it does not rotate the development motor 71 (S8), saving thereby the time which will have been spent to initialize the developing device 4*a*, because, if the developing device 4*a* is not brand-new, the seals 51*a* and 51*b* have already been wound up.

Then, the control section 50 determines the amount of toner in the hopper 25, based on the signals from the residual toner amount sensor 21*a* and 21*b* (S9). If the hopper 25 is full with toner (Yes in S9), the control section 50 starts an image forming operation (S5).

If no toner is in the hopper 25 (No in S9), the control section 50 activates the bottle motor 72 to rotate the toner container Ta to supply the hopper 25 with toner (S10).

If the top surface of the body of toner in the hopper 25 does not reach the residual toner amount sensor 21*a* and 21*b* even after the toner container Ta was rotated for a preset length of time during the driving of the bottle motor 72 (S7 and S10), the control section 50 determines that the toner container Ta is empty, and displays a message which prompts a user to replace the toner container Ta.

According to the above-described control sequence in this embodiment, the initial supply of developer is regulated in movement by the toner seals 51*a* and 51*b*. Therefore, it does not occur that as replenishment developer is delivered from the toner container Ta into the toner supplying device 20*a*, the replenishment developer travels straight through the toner supplying device 20*a* while maintaining the speed at which it was delivered to the device 20*a*. Therefore, it does not occur that toner flies up in the developing means container 101 and scatters out of the developing means container 101 through the gaps in the immediate adjacencies of the development sleeve 102.

Further, the movement of the initial supply of developer is regulated by the toner seals 51*a* and 51*b*. Therefore, it does not occur that the toner density in the developing means container 101 is unintendedly changed by a large amount of replenishment developer delivered from the toner container Ta. Therefore, it does not occur that the image forming apparatus 200 outputs images which are nonuniform in density, immediately after the installation of a brand-new developing device 4*a*. Further, not only does it not occur that developer scatters from the developing device 4*a* after the installation of a brand-new developing device 4*a*, but also, it does not occur that the image forming apparatus 200 outputs images which are nonuniform in density because of the nonuniformity of the developer in terms of toner density.

Further, if a developing device 4*a*, which is not brand-new, is installed, the operation for winding the seals 51*a* and 52 is not carried out. In other words, time is not wasted for an unnecessary operation. Therefore, the image forming apparatus 200 is reduced in the length of time spent for its start-up, each time it is started up, and also, it does not occur that the developer in the developing device 4*a* is made to deteriorate, by the unnecessary stirring of the developer.

<Embodiment 2>

Figure 9:
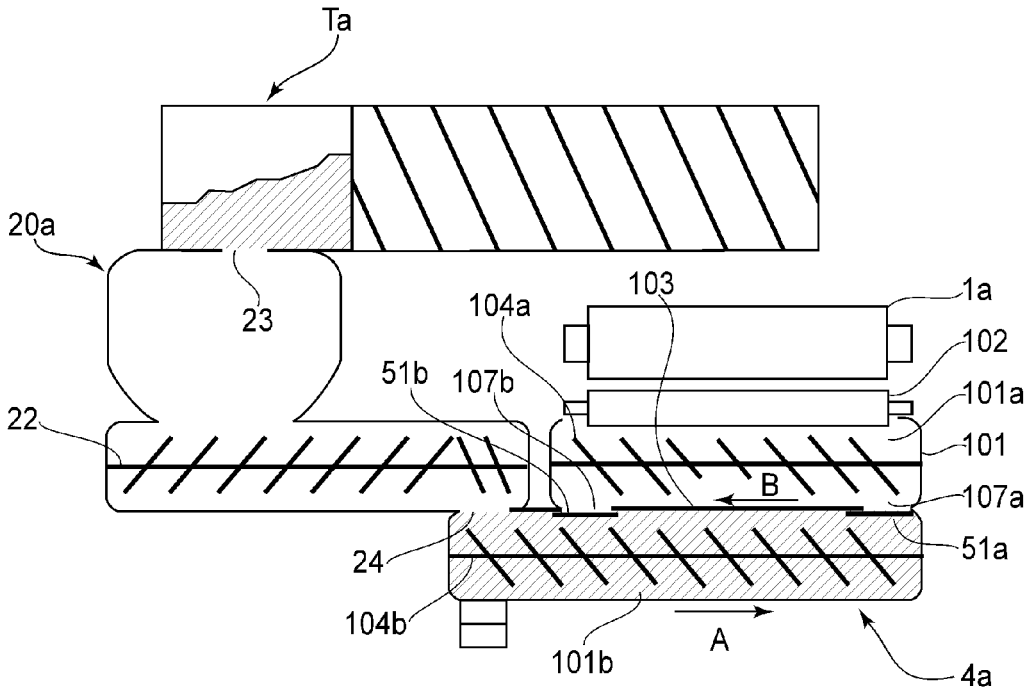
FIG. 9 is a schematic sectional view of the development device in the second embodiment of the present invention, prior to the unsealing of the device (prior to removal of seals), at a plane which is parallel to, and coincides with, the axial line of the development roller of the device. It shows the 7 general structure of the device
Figure 10:
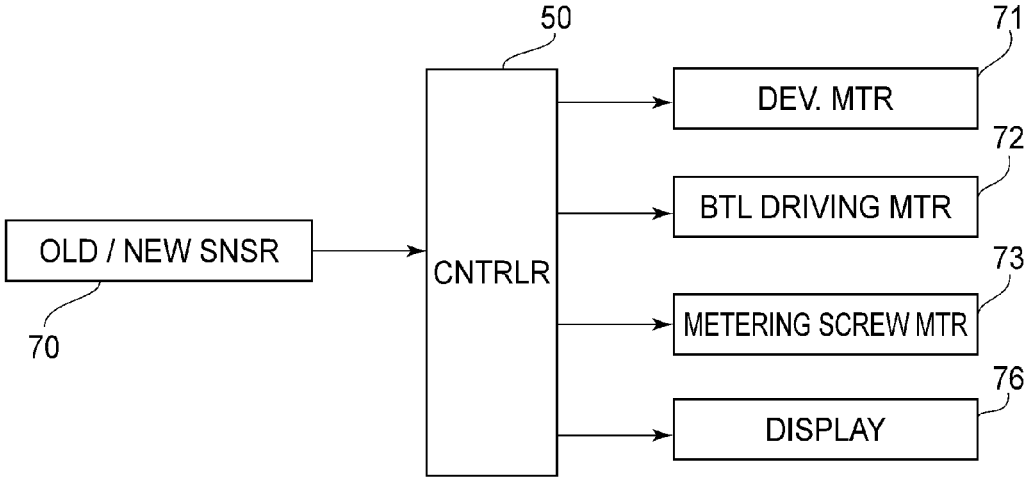
FIG. 10 is a block diagram of a combination of the control sequence for replenishing the developing device with toner, and the control sequence for releasing the initial supply of developer in a brand-new developing device, in the second embodiment.
Figure 11:
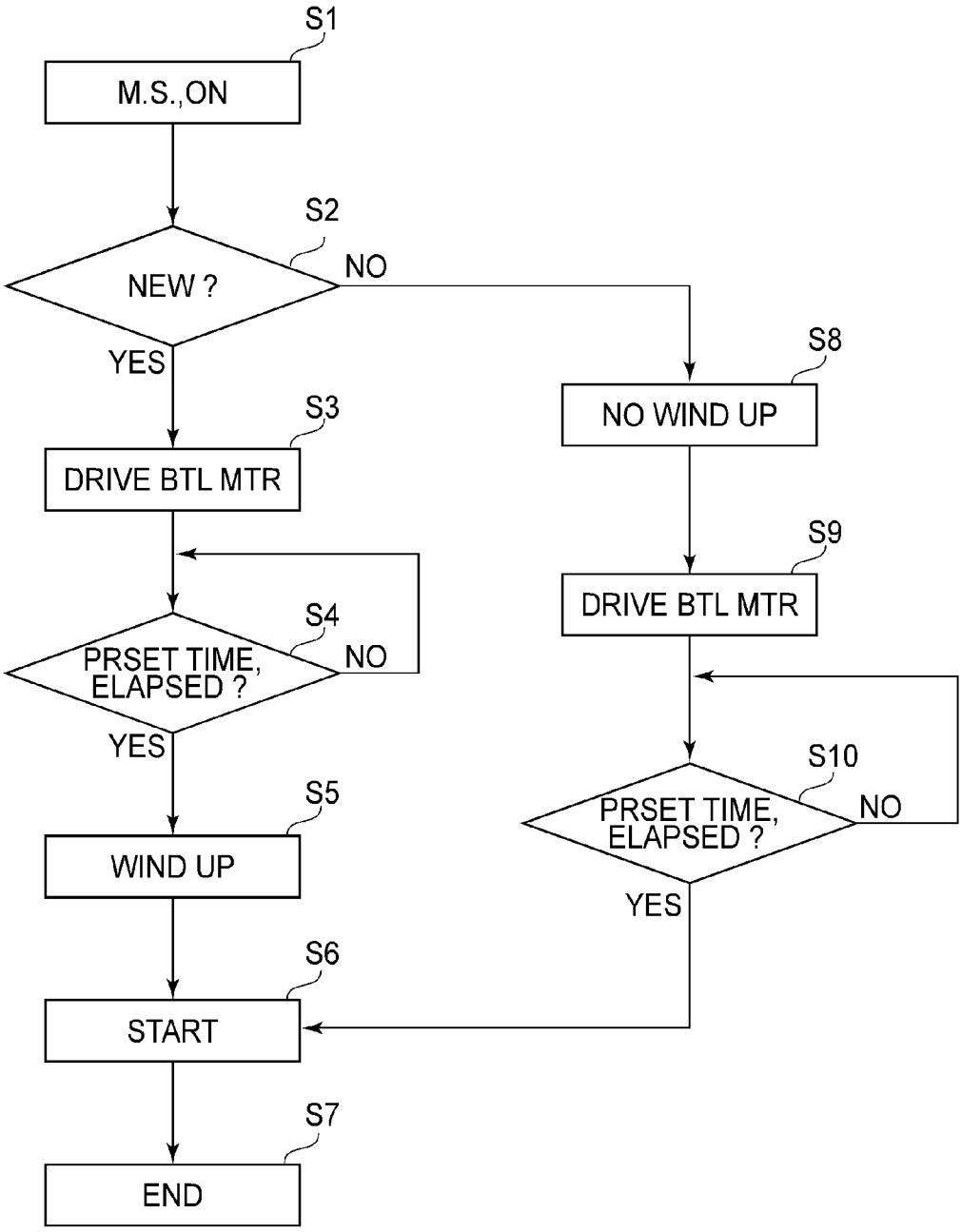
FIG. 11 is a flowchart of the control sequence, in the second embodiment, for winding away the developer seals.
Figure 12:
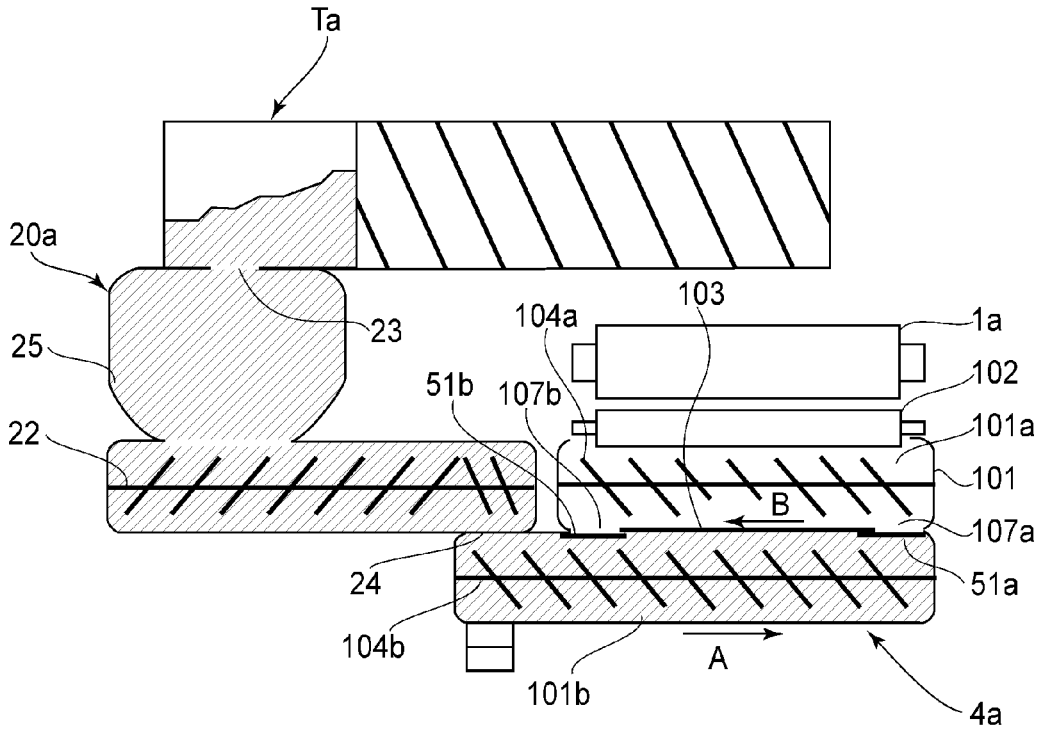
FIG. 12 is a schematic sectional view of the developing device in the second embodiment, prior to the unsealing of the device (prior to removal of developer seals), and shows where in the developing device the replenishment toner and initial supply of developer are prior to the removal of developer seals.
Figure 13:
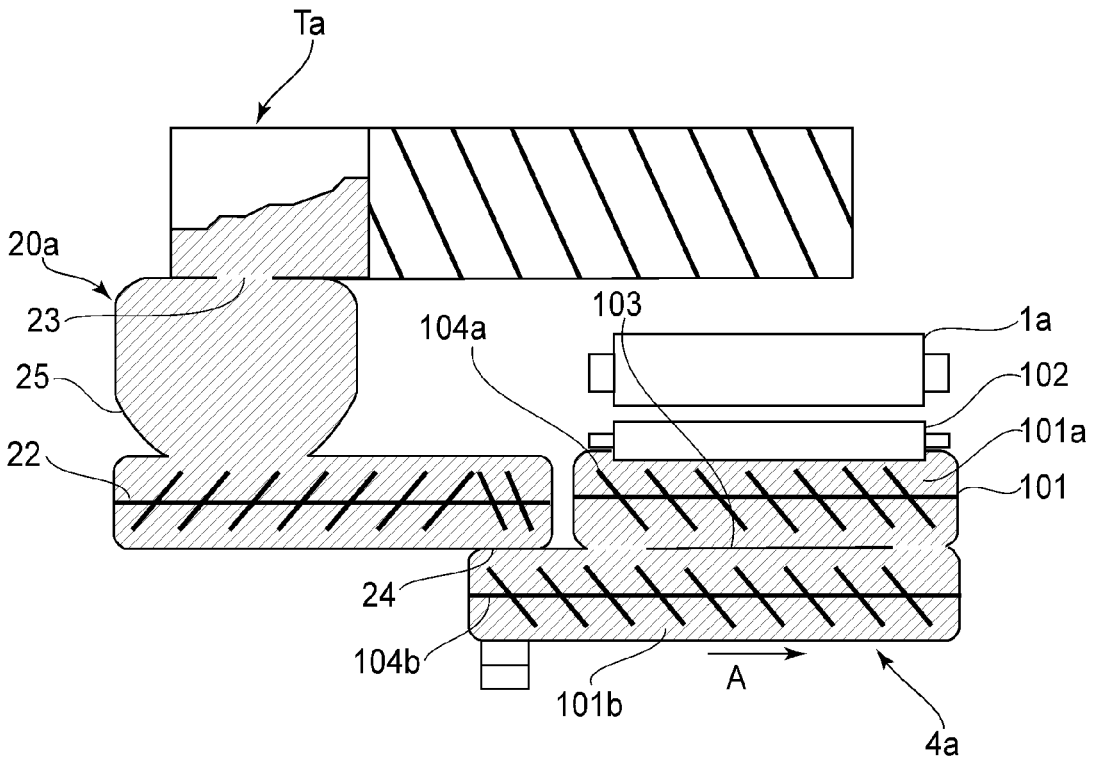
FIG. 13 is a schematic sectional view of the developing device in the second embodiment, after the unsealing of the device (after removal of developer seals), and shows where in the developing device the replenishment toner and initial supply of developer are after the removal of developer seals.

FIG. 9 is the development device in the second embodiment of the present invention, prior to its unsealing (removal of seals 51*a* and 51*b*), at a plane which is parallel to, and coincides with, the axial line of the development roller. It shows the general structure of the device prior to the unsealing. FIG. 10 is a block diagram of the control sequence for replenishing the developing device with toner and that for unsealing a brand-new developing device. FIG. 11 is a flowchart of the control sequence, in the second embodiment, for winding away (removing) the toner seals. FIG. 12 is a schematic sectional view of the developing device in the second embodiment, prior to the removal of the toner seals (prior to unsealing of device). It shows the state of the developing device while the toner supplying device is replenished with toner prior to the removal of the toner seals. FIG. 13 is a schematic sectional view of the developing device in the second embodiment, after the removal of the toner seals (after unsealing of device), and shows the state of the developing device after the removal of the toner seals.

Referring to FIG. 9, the developing device 4*a* and toner supplying device 20*a* in the second embodiment, which are initialized in the seal removal mode, is the same in structure as those in the first embodiment, which are shown in FIG. 3, except that those in the second embodiment are not provided with the residual toner amount sensors 21*a* and 21*b*. Thus, the structural components of the developing device 4*a* and toner supplying devices 20*a* in this embodiment, which are shown in FIGS. 9, 10, 12 and 13, and are the same as the counterparts in the first embodiment, which are shown in FIGS. 3, 4, 7 and 8, are given the same referential codes as those given to the counterparts in the first embodiment, and are not going to be described here.

Referring to FIG. 10, the information about whether or not the developing device 4*a* in the image forming apparatus 200 is a brand-new is inputted, in the form of electrical signals, into the control section 50 from the developing device status sensor 70. As the control section 50 receives the information, it activates a development motor 71, a bottle motor 72, and a measurement screw motor 73, based on a prescribed flowchart. Further, it displays, on the display 76, the status of the image forming apparatus 200, which is based on the control sequence.

Next, referring to FIG. 11, in the seal removal mode in the second embodiment, the seal removal mechanism 60 is activated after the toner container Ta is rotated for a preset length of time. As the main assembly of the image forming apparatus 200 is turned on (S1), the control section 50 determines whether or not the developing device 4*a* in the main assembly is literally brand-new, based on the signals from the developing device status sensor 70 (S2). If the developing device 4*a* is brand-new (Yes in S2), the control section 50 activates the bottle motor 72 to rotate the toner container Ta to supply toner to the hopper 25 (S3).

The control section 50 obtains in advance how much toner is discharged per unit length of time from the toner container Ta. As it rotates the toner bottle Ta, it waits until the preset length of time elapses (S4). The length of time (preset length of time) the control section 50 rotates the toner container Ta is adjusted by the control section 50 according to the state of the toner container Ta. That is, it is shortest when the toner container Ta is brand-new. Then, it is increased as the toner container Ta reduces in the amount of toner therein. The control section 50 determines the state of the toner container Ta (amount of toner in container Ta), based on the current value of the bottle motor 72; the greater the current value, the greater the amount of toner in the toner container TA, and the smaller the current value, the smaller the amount of toner in the toner container Ta (closer to be empty the container Ta). Incidentally, the toner container Ta may be provided with a memory tag such as the one with which the developing device 4*a* is provided, so that the control section 50 can determine the status of the toner container Ta by reading from the memory tag, the cumulative length of time the toner container Ta has been rotated.

Referring to FIG. 12, as the toner container Ta is rotated for a preset length of time, the inside of the toner supplying device 20*a* is filled up with toner. At this point in time, however, the initial supply of developer in the stirring chamber 101*b* is still regulated in its movement by the partition wall 103, toner seal 51*a*, and toner seals 51*b*. Therefore, it does not occur that as toner is supplied to the developing device 4*a* from the toner container Ta, the supplied toner travels straight through the developing means container 101 while maintaining the speed at which it is delivered into the developing device 4*a*. Therefore, it does not occur that toner scatters through the gap (SD gap) between the peripheral surface of the development sleeve 102 and the peripheral surface of the photosensitive drum 1*a*. Further, it does not occur that the initial supply of developer in the developing means container 101 is unintendedly changed in toner density by the mixing of a large amount of toner into the initial supply of developer. Therefore, it does not occur that after the installation of a brand-new developing devise 4*a* (cartridge) into the main assembly of the image forming apparatus 200, the image forming apparatus 200 outputs images which are non-uniform in density.

After the elapse of the preset length of time (Yes in S4), the control section 50 activates the development motor 71, rotating thereby the toner seal winding member 600 in the direction indicated by the arrow mark R9 as shown in FIG. 2(*b*) (S5). Thus, the toner seals 51*a* and 51*b* welded to the inward surface of the developing means container 101 and the partition wall 103 are separated from the inward surface of the developing means container 101 and the partition wall 103, and are wrapped around the toner seal winding member 60.

As the rotation of the development motor 71 continues, the stirring chamber screws 104*b* and development chamber screw 104*a* also continues to rotate, spreading thereby the developer into the developing means container 101, including the development chamber 101*a*. Then, the control section 50 starts an image forming operation (S6).

If the control section 50 determines, based on the information from the developing device status sensor 70 of the developing device 4*a*, that the developing device 4*a* in the main assembly of the image forming apparatus 200 is not brand-new (No in S2), it does not start rotating the development motor 71 (S8), because, that the developing device 4*a* is not brand-new means that the toner seals 51*a* and 51*b* had already been wound away, and therefore, the step of driving the development motor 71 to remove the seals 51*a* and 51*b* can be skipped to save time.

Then, the control section 50 activates the bottle motor 72 to rotate the toner container Ta to supply the hopper with toner (S9), while checking whether or not a preset length of time has elapsed. As soon as the preset length of time elapses (Yes in S10), that is, as soon as the toner supplying device 20*a* is filled up with toner, the control section 50 starts an image forming operation (S6).

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 093905/2011 filed Apr. 20, 2011, which is hereby incorporated by reference.

What is claimed is:

1. An image forming apparatus comprising:

an image bearing member for bearing an electrostatic image;

a detachable developer container configured to accommodate a developer;

a hopper portion configured to temporarily accommodate the developer supplied from said developer container and capable of feeding the developer;

a developing device configured to develop a latent image formed on said image bearing member, said developing device being contactable to and separable from said hopper portion by relative movement between said hopper and said developing device, and capable of receiving the developer fed out of said hopper portion;

a removable sealing member configured to seal said developing device to confine an initial developer in said developing device;

an unsealing mechanism for unsealing said sealing member; and a controller configured to control a supplying operation from said developer container to start supply of the developer from said developer container into said hopper portion at timing earlier than a start of removal of said sealing member.

2. The image forming apparatus according to claim 1, wherein said controller permits the unsealing operation of said unsealing mechanism in response to formation indicating that an amount of developer in said hopper portion is not less than a predetermined amount.

3. The image forming apparatus according to claim 1, further comprising a sensor configured to detect an amount of the developer in said hopper portion, and said controller controls an unsealing operation of said unsealing mechanism on the basis of a result of detection of said sensor.

4. The image forming apparatus according to claim 1, wherein said hopper portion is disposed above said developing device, and said developer container is disposed above said hopper portion.

5. The image forming apparatus according to claim 1, wherein said developing device includes a developer carrying member configured to carry the developer to a developing position where it is opposed to said image bearing member, a first chamber configured to supply the developer to said developer carrying member, and a second chamber constituting a circulation path through which the developer is circulated through an interconnection path at opposite ends of said first chamber, wherein said sealing member seals the interconnection path.

* * * * *